US009463363B2

(12) United States Patent
Dingman et al.

(10) Patent No.: US 9,463,363 B2
(45) Date of Patent: Oct. 11, 2016

(54) GRIP AND INTERNAL WEIGHT SYSTEM FOR A GOLF CLUB HAVING A STOPPER WITHIN THE GRIP

(71) Applicant: SSG International, LLC, Wixom, MI (US)

(72) Inventors: Dean Dingman, Brighton, MI (US); Chris Lee, Beijing (CN)

(73) Assignee: SSG International, LLC, Wixom, MI (US)

( * ) Notice: Subject to any disclaimer, the term of this patent is extended or adjusted under 35 U.S.C. 154(b) by 0 days.

(21) Appl. No.: 14/636,289

(22) Filed: Mar. 3, 2015

(65) Prior Publication Data

US 2015/0251063 A1 Sep. 10, 2015

Related U.S. Application Data

(60) Provisional application No. 61/947,570, filed on Mar. 4, 2014.

(51) Int. Cl.
*A63B 53/16* (2006.01)
*A63B 53/14* (2015.01)

(52) U.S. Cl.
CPC ..... *A63B 53/14* (2013.01); *A63B 60/16* (2015.10); *A63B 60/22* (2015.10); *A63B 60/24* (2015.10); *A63B 2209/00* (2013.01)

(58) Field of Classification Search
CPC .... A63B 53/145; A63B 53/14; A63B 53/16; A63B 60/22; A63B 60/16; A63B 60/24; A63B 2209/00
See application file for complete search history.

(56) References Cited

U.S. PATENT DOCUMENTS

| | | | | |
|---|---|---|---|---|
| 1,634,082 | A | 6/1927 | Rigby | |
| 1,634,887 | A | 7/1927 | Rigby | |
| 4,461,479 | A | 7/1984 | Mitchell | |
| 4,826,168 | A | 5/1989 | McGuire et al. | |
| 5,152,527 | A | 10/1992 | Mather et al. | |
| 5,203,561 | A | 4/1993 | Lanctot | |
| 5,228,688 | A | 7/1993 | Davis | |
| 5,364,102 | A | 11/1994 | Appledorn | |
| 5,465,967 | A * | 11/1995 | Boeckenhaupt ..... | A63B 60/24 473/297 |
| 5,741,193 | A | 4/1998 | Nolan | |
| 5,879,241 | A | 3/1999 | Cook et al. | |
| 6,364,787 | B1 | 4/2002 | Huiskamp | |

(Continued)

FOREIGN PATENT DOCUMENTS

| | | | |
|---|---|---|---|
| GB | 154792 | A | 12/1920 |
| JP | S61174967 | U | 10/1986 |

(Continued)

OTHER PUBLICATIONS

International Search Report and Written Opinion regarding Application No. PCT/US2015/018682, ISA/KR, mailed May 22, 2015.

*Primary Examiner* — Stephen Blau
(74) *Attorney, Agent, or Firm* — Harness, Dickey & Pierce, P.L.C.

(57) ABSTRACT

A golf club grip for a golf club includes an elongated member having a first end, a second end, an inner surface and an outer surface. The first end is configured to receive a golf club shaft. The second end includes an opening that comprises an insert having a first threaded portion therein. The elongated member comprises a stopper extending inward from the inner surface a predetermined distance. The stopper separates the golf club shaft and insert.

26 Claims, 7 Drawing Sheets

(56) References Cited

U.S. PATENT DOCUMENTS

| | | | | |
|---|---|---|---|---|
| 6,506,128 | B1 | 1/2003 | Bloom, Jr. | |
| 7,267,619 | B1 | 9/2007 | Pettis | |
| 7,481,716 | B1 * | 1/2009 | Johnson | A63B 60/24 473/297 |
| 7,699,718 | B2 | 4/2010 | Lindner | |
| 7,704,160 | B2 | 4/2010 | Lindner | |
| 8,177,658 | B1 | 5/2012 | Johnson | |
| 8,591,350 | B2 | 11/2013 | Evans et al. | |
| 8,641,551 | B2 | 2/2014 | Johnson | |
| 8,814,718 | B1 | 8/2014 | Rollinson et al. | |
| 8,814,719 | B2 * | 8/2014 | Wall, Jr. | A63B 53/14 473/300 |
| 8,888,606 | B2 * | 11/2014 | Boccieri | A63B 53/145 473/297 |
| 2003/0157990 | A1 | 8/2003 | Bloom | |
| 2004/0147339 | A1 | 7/2004 | Lindner et al. | |
| 2004/0224787 | A1 | 11/2004 | Lindner | |
| 2005/0079925 | A1 | 4/2005 | Cheng et al. | |
| 2007/0161431 | A1 | 7/2007 | Lindner | |
| 2008/0132350 | A1 | 6/2008 | Gill et al. | |
| 2008/0227562 | A1 | 9/2008 | Gill | |
| 2008/0274822 | A1 | 11/2008 | Lindner | |
| 2008/0274823 | A1 | 11/2008 | Lindner | |
| 2010/0081515 | A1 | 4/2010 | White et al. | |
| 2010/0105498 | A1 | 4/2010 | Johnson | |
| 2011/0159982 | A1 * | 6/2011 | Takeuchi | A63B 60/22 473/299 |
| 2012/0071258 | A1 | 3/2012 | Yamaguchi et al. | |
| 2013/0165249 | A1 * | 6/2013 | Margoles | A63B 53/16 473/297 |
| 2014/0221121 | A1 * | 8/2014 | Margoles | A63B 53/16 473/297 |
| 2014/0342845 | A1 | 11/2014 | Dingman | |
| 2015/0105175 | A1 * | 4/2015 | Wang | A63B 53/14 473/300 |
| 2015/0231462 | A1 | 8/2015 | Chapin | |
| 2015/0251063 | A1 | 9/2015 | Dingman et al. | |
| 2015/0251064 | A1 | 9/2015 | Chapin | |
| 2015/0360101 | A1 | 12/2015 | Solhaug | |

FOREIGN PATENT DOCUMENTS

| | | | | |
|---|---|---|---|---|
| JP | H0866500 | A | | 3/1996 |
| JP | 2011167243 | A | * | 9/2011 |
| KR | 2020140001727 | | | 3/2014 |
| WO | 2005061058 | A1 | | 7/2005 |

* cited by examiner

GRIP AND INTERNAL WEIGHT SYSTEM FOR A GOLF CLUB HAVING A STOPPER WITHIN THE GRIP

CROSS-REFERENCE TO RELATED APPLICATIONS

This application claims the benefit of U.S. Provisional Application No. 61/947,570 filed on Mar. 4, 2014. The entire disclosure of the above application is hereby incorporated by reference.

FIELD

The present disclosure relates to a grip for a golf club, and more particularly, to a grip including an internal weight system for a golf club.

BACKGROUND

This section provides background information related to the present disclosure and is not necessarily prior art.

In addition to the refinement of a golfer's swing, the weight of a golf club can affect the distance and accuracy of a golf shot. Putting feel is important for accuracy. Different manufacturers provide different ways for changing the feel of a putter. Providing weights are one manner for changing the feel of a golf club.

SUMMARY

It may be advantageous for a golfer to be able to adjust the weight of a golf club to improve and/or perfect the distance and accuracy of a golf shot.

In one aspect of the disclosure, a golf club grip for a golf club includes an elongated member having a first end, a second end, an inner surface and an outer surface. The first end is configured to receive a golf club shaft. The second end includes an opening that comprises an insert having a first threaded portion therein. The elongated member comprises a stopper extending inward from the inner surface a predetermined distance. The stopper separates the golf club shaft and insert.

Further areas of applicability will become apparent from the description provided herein. It should be understood that the description and specific examples are intended for purposes of illustration only and are not intended to limit the scope of the present disclosure.

DRAWINGS

The drawings described herein are for illustrative purposes only of selected examples and not all possible implementations, and are not intended to limit the scope of the present disclosure.

Corresponding reference numerals indicate corresponding parts throughout the several views of the drawings.

DETAILED DESCRIPTION

Figure 1:
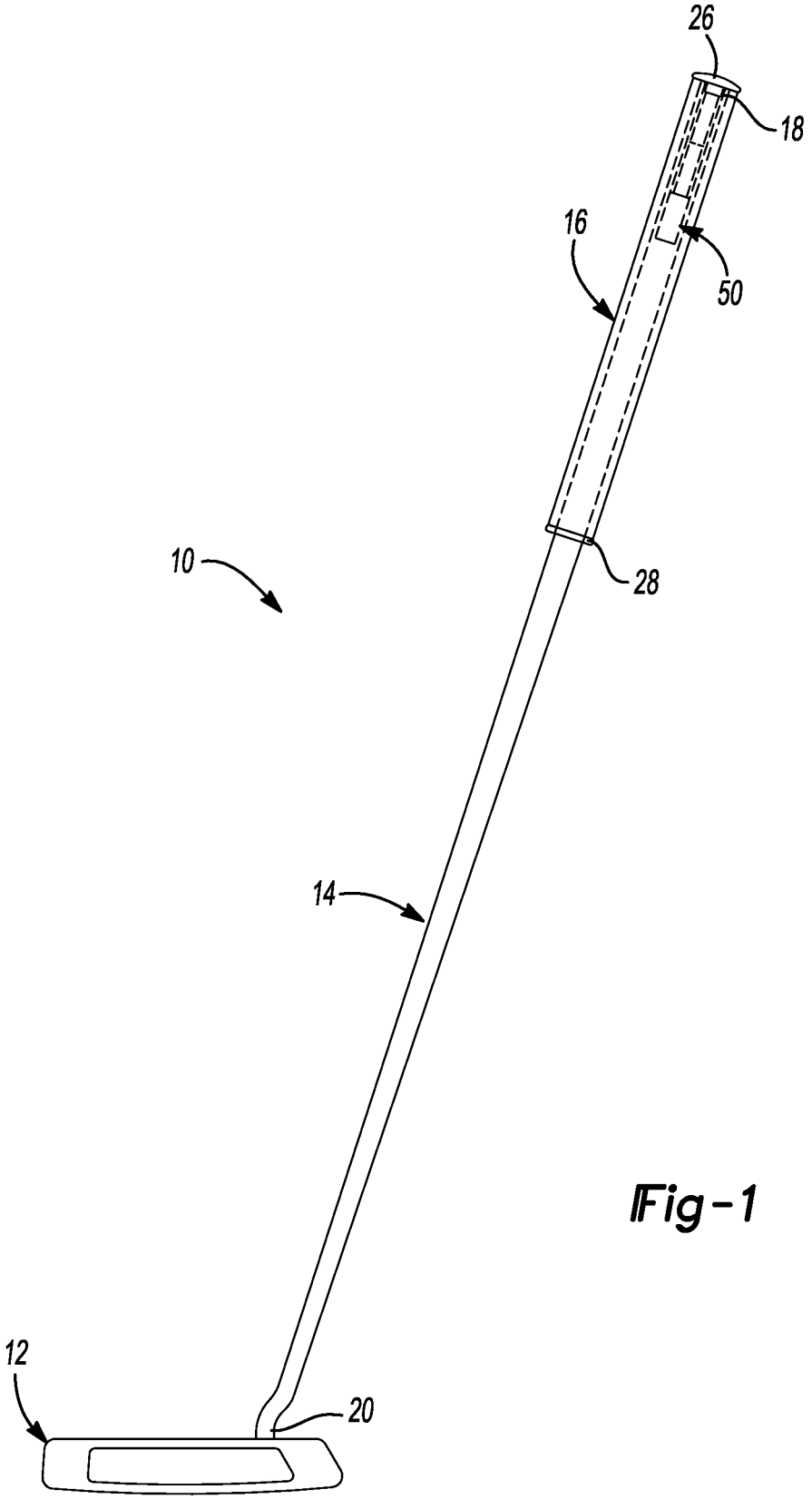
FIG. 1 is a front view of an exemplary golf club including the grip and the internal weight system in accordance with the teachings of the present disclosure, the exemplary golf club also includes a shaft and a head.

The following description is merely exemplary in nature and is not intended to limit the present disclosure, application, or uses. For purposes of clarity, the same reference numbers will be used in the drawings to identify similar elements. Examples are provided so that this description will be thorough, and will fully convey the scope to those who are skilled in the art. Numerous specific details are set forth, such as examples of specific components, to provide a thorough understanding of examples of the present disclosure. It will be apparent to those skilled in the art that specific details need not be employed, that examples may be embodied in many different forms, and that neither should be construed to limit the scope of the description. Moreover, it should be understood that the teachings of the present disclosure may be applied to other applications where it may advantageous and/or desirable to adjust the weight of a device. For example, such applications may include, but are not limited to: a tennis racquet, a fishing pole, and/or a hockey stick.

With reference to FIG. 1, a golf club 10 including a head 12, a shaft 14, and a grip 16 is shown. The head 12 may be configured to hit a golf ball (not shown) from various locations on a golf course. For example, the head 12 may be configured to hit a golf ball from a putting green (i.e., a putter, as shown), from a tee box (i.e., a driver), or from a fairway, rough, or bunker (i.e., an iron or wedge).

With reference to FIGS. 1-6, the shaft 14 is an elongated member extending between a first end 18 and a second end 20. The shaft 14 may be fabricated from a suitable material, such as metal (i.e., a steel shaft) or carbon fiber (i.e., a graphite shaft). The first end 18 of the shaft 14 is configured to receive the grip 16, and the second end 20 the shaft 14 is secured to head 12. The shaft 14 may maintain a uniform cross-section between the ends 18, 20, or the cross-section may taper between the first end 18 and the second end 20. The shaft 14 may be hollow throughout the ends 18, 20, or the shaft 14 may include a bore at least partially extending from the first end 18 towards. Accordingly, the shaft 14 includes an outer surface 22 and an inner surface 23 at least near the first end 18, an inner channel or cavity 24. The distance between the outer surface 22 and the inner surface 23 defines the thickness of the shaft 14. The inner surface 23 defines the cavity 24 therein The grip 16 is an elongated and hollow member that may be fabricated from a suitable material, such as a natural or synthetic rubber or elastomeric material. The grip 16 includes a first end 26, an opposing second end 28, an inner grip cavity 30, and an outer grip surface 32.

The first end 26 may be referred to as a butt end. The first end 26 of the grip 16 includes an opening 33 configured to receive an insert 34 for attaching an internal weight system 50 to the grip 16. The second end 28 of the grip 16 may include a second opening configured to receive the shaft 14 into the inner grip cavity 30. The shaft 14 may be received in the inner grip cavity 30 such that the outer surface 22 at the first end 18 the shaft 14 is generally flush with or aligned with the first end 26 of the grip 16. The shape of the inner grip cavity 30 may correspond to the shape of the outer surface 22 of the shaft 14, at least near the first end 18 of the shaft 14. Stated another way, if the outer surface 22 of the shaft 14, at least near the first end 18, includes a circular or pentagonal shape, then the inner grip cavity 30 may likewise include a circular or pentagonal shape, respectively. An adhesive or bonding agent may be applied between the inner grip cavity 30 and the outer surface 22 of the shaft 14 to restrict the grip 16 from slipping laterally and/or rotating axially relative to the shaft 14. The outer grip surface 32 may include any shape, such as a cylindrical, pentagonal, hexagonal, or ovoid shape, for example.

Figure 2:
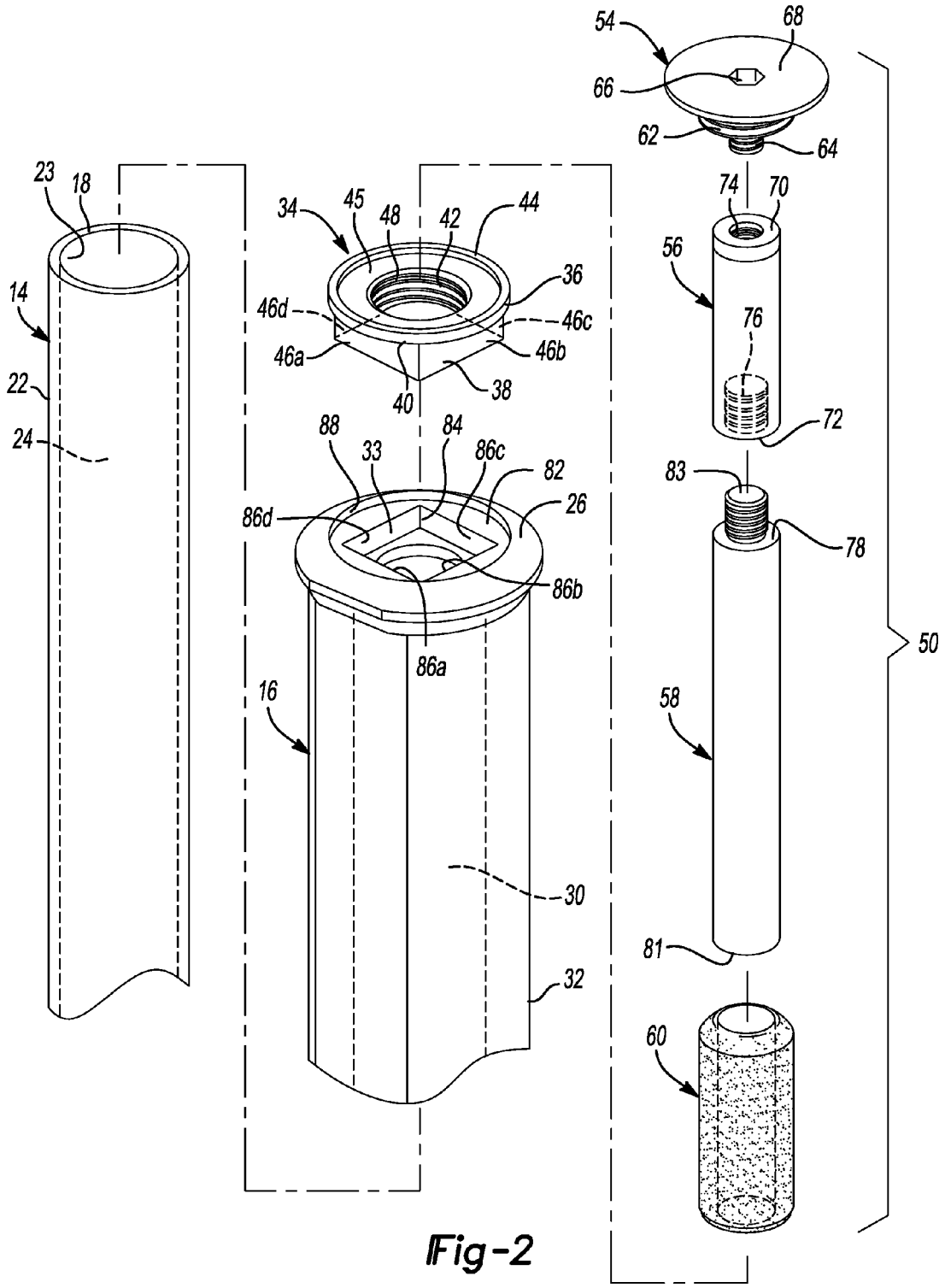
FIG. 2 is a partially exploded perspective view of the grip, the insert, and the shaft.
Figure 3B:
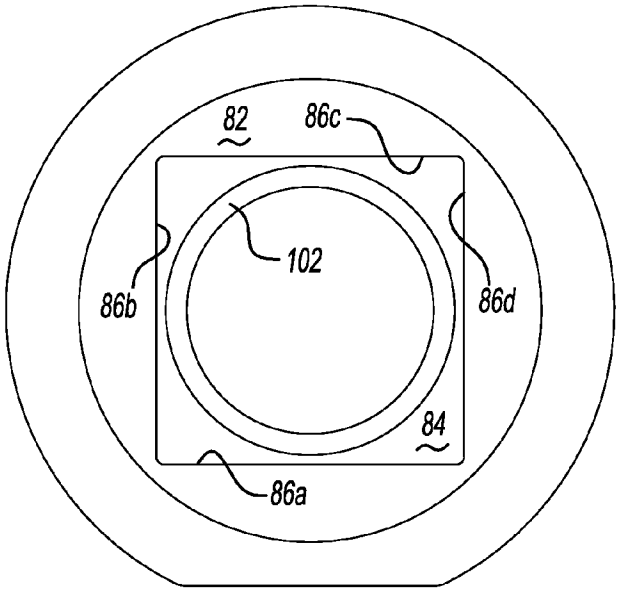
FIG. 3B is a top view of the grip without an insert therein along line 3B-3B of FIG. 3A.
Figure 3A:
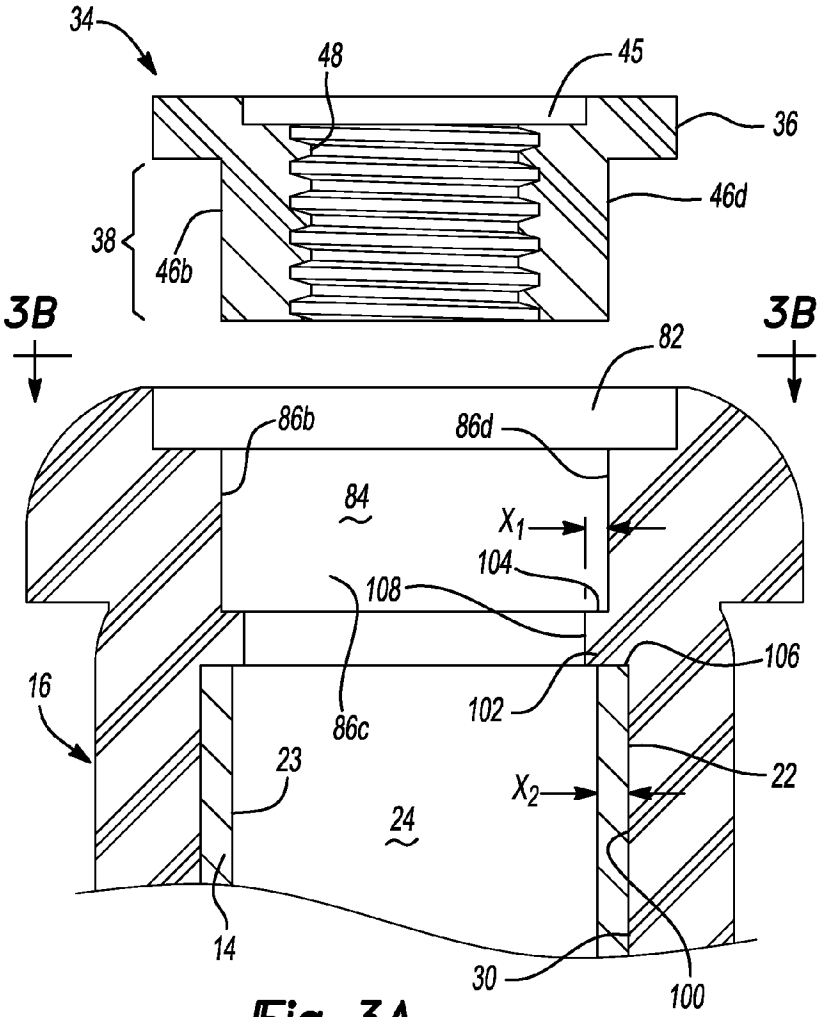
FIG. 3A is a partially exploded cross-sectional view of the grip, the internal weight system, and the shaft.
Figure 4A:
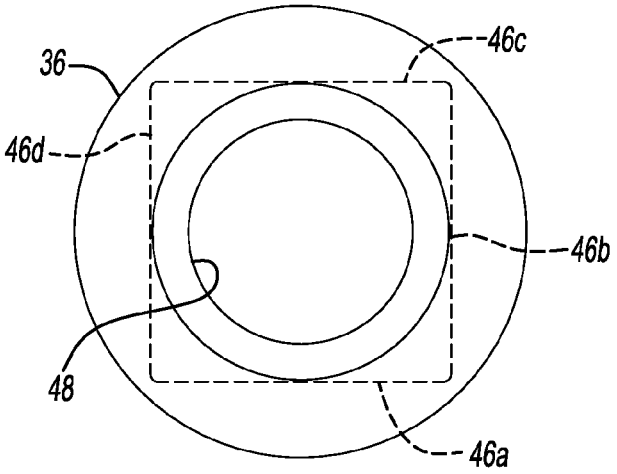
FIG. 4A is a top view of the insert.
Figure 5:
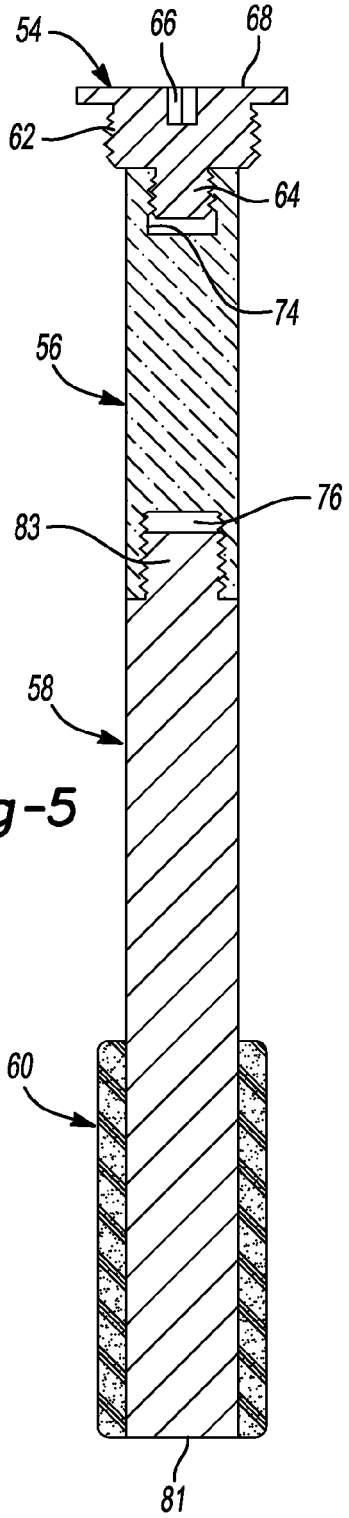
FIG. 5 is a cross-sectional view of the internal weight system.
Figure 4B:
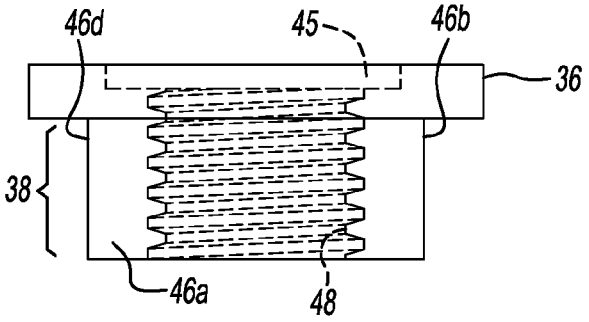
FIG. 4B is a side view of the insert.

With reference specifically to FIGS. 2-4 the insert 34 is may be fabricated from a suitable material, such as metal, nylon or a polymeric material. The insert 34 includes an annular flange 36 and a body 38. The body 38 includes an outer surface 40 and an inner surface 42. The insert 34 may be received in the opening 33 the grip 16 such that an upper surface 44 of the annular flange 36 is generally flush with the first end 26 of the grip 16. The upper surface 44 has a recess 45 for receiving the flange of the weight cap 54.

The body 38 may be polygonal in cross-section comprising a plurality of walls 46*a*, 46*b*, 46*c*, 46*d*. In this example four walls 46*a*, 46*b*, 46*c*, 46*d* form the polygonal outer shape of the body. However, three or more walls may be used. The polygonal shape may not be a regular polygon. The polygonal shape may have walls of differing lengths. The walls 46*a*, 46*b*, 46*c*, 46*d* are configured to engage the inner grip cavity 30 and may prevent axial rotation and/or lateral movement of the insert 34 relative to the grip 16. An adhesive or bonding agent may be applied between the grip 16 and the insert 34 to secure the insert 34 into the opening.

A threaded portion 48 located within the inner surface 42 of the annular body 38 is configured to selectively threadably engage and attach the weight system 50 and a grip cap 52, both described below, to the insert 34 and ultimately to the grip 16. In another example described in detail below, the insert 34 may be over-molded or integrally formed with the grip 16.

The first end 26 of the grip 16 may also be referred to as an end cap 80. The end cap 80 may have a shape that corresponds to the outer shape of the insert 34. In this example, the insert 34 has a circular recess 82 that corresponds to the shape of the flange 36. The circular recess 82 has a depth that corresponds to the thickness of the flange 36. The circular recess 82 extends axially inward from the end of the end cap 80. The end cap 80 or the grip 16 may also include a polygonal recess 84. The polygonal recess 84 has a shape size to receive the body 38 of the insert 34. In the present example, four walls 46A, 46B, 46C, 46D are used to form the body 38. The polygonal recess 84 also has four sides 86A, 86B, 86C, 86D that extend below or axially inward (longitudinally) from the first end 26 of the grip. That is, the sides, 86A, 86B, 86C and 86D extend axially inward from a flat surface 88 upon which the flange 36 rests after insertion. The inner surface 42 of the insert 34 and other portions of the grip are formed without obstructions so that the weight 50 may be easily inserted therein.

Referring specifically to FIG. 3A, a cutaway view of a grip 16 illustrated with a shaft 14 inserted therein. In this example, the insert 34 is exploded away for illustrative purposes so that the threads 48 may be seen.

The grip 36 has an inner wall 100. The inner wall 100 is illustrated adjacent to the outer wall 22 of the shaft 14. The inner wall 100 has a stopper 102 extending inwardly therefrom. The stopper 102, in the illustrated example, is a circular or annular shaped band. The stopper 102 may be a continuous band around the circumference of the inner wall 100. The stopper 102 prevents the shaft 14 from pushing the insert 34 outward upon assembly. The stopper 102 extends a distance $X_1$ radially from the inner wall 100 of grip 16. The inner wall 23 of the shaft 14 extends a distance $X_2$ from the inner wall 100. Preferably, the distance $X_2$ is less than the distance $X_1$ corresponding to the extension of the stopper 102. This allows the weight system 50 to be easily inserted into the cavity 30 without the shaft forming an obstruction. The distance $X_2$ may also be equal to the distance $X_1$. The body 38 of the insert 34 is thus separated from the shaft 14 by the stopper 102 when assembly to a shaft is finished. The diameter $D_1$ corresponding to of the opening of the stopper 102 may correspond to the clear diameter $D_2$ of the threads 48 of the insert 34. Thus, as is best illustrated in FIG. 3B, a clear opening formed by the alignment of the threads 48, the stopper 102 and the internal cavity 24 of the shaft are aligned so that the weight system 50 may be easily inserted therein in an obstructed way.

The stopper 102 comprises a first wall 104, a second wall 106 and a third wall 108. The first wall 104 extends from the inner wall 100 of the grip perpendicular to the inner wall 100 in the present example. The second wall 106 also extends in a direction perpendicular to the wall 100 of the grip 16 in the present example. The third wall 108 may extend in a direction perpendicular to both the first wall 104 and the second wall 106 as is illustrated in the present example. The first wall 104, the second wall 106, and the third wall 108 form a step having a step shape. Thus, the stopper 102 is a step-shaped stopper. When fully assembled, the shaft 14 is directly adjacent to the stopper 102. In particular, the shaft 14 is directly adjacent to the second wall 106 of the stopper 102. The thickness of the stopper 102 corresponding to the length of the third wall 108 prevents the shaft 14 from displacing the insert 34 during assembly.

With reference to FIGS. 1-4, the weight system 50 may be selectively inserted into the first end 26 of the grip 16 and into the cavity 24 of the shaft 14, and is configured to threadably engage the insert 34. The weight system 50 includes a weight cap 54, a spacer 56, a weight 58, and a sleeve 60.

The weight cap 54 is an annular member that may be fabricated from a suitable material, such as metal or a polymeric material. The weight cap 54 includes a first threaded portion 62, a second threaded portion 64 located below the first threaded portion 62, and a securing socket 66 located on a top end 68 of the first threaded portion 62. The first threaded portion 62 of the weight cap 54 is configured to threadably engage the threaded portion 48 of the insert 34 to secure the weight system 50 to the grip 16. The second threaded portion 64 of the weight cap 54 is configured to threadably engage the spacer 56, described below. The top end 68 of the weight cap 54 may be fabricated from, or over molded with, the same material as the grip 16 to provide a "finished" or uniform look when the weight system 50 is attached to the grip 16. The securing socket 66 may have a hexagonal shape, for example, which may be engaged with a securing key, such as a hex key (not shown), for example.

The securing socket 66 may be used for tightening and attaching the weight cap 54 and the weight system 50 to the insert 34, or, alternatively, for loosening and separating the weight cap 54 and the weight system 50 from the insert 34.

The spacer 56 is an elongated member that may be fabricated from a suitable material, such as metal, graphite, or a polymeric material. The spacer 56 includes a first end 70 and an oppositely located second end 72. At the first end 70, the spacer 56 includes a first threaded portion 74 configured to threadably engage the second threaded portion 64 of the weight cap 54. At the second end 72, the spacer 56 includes a second threaded portion 76 configured to threadably engage the weight 58, described below. The spacer 56 may include a variety of lengths, providing a user with the ability to customize the location of the center of gravity of the golf club 10 relative to the ends 18, 20 of the shaft 14. For example, a user may use a longer spacer to position the center of gravity of the golf club 10 closer to the head 12, or, alternatively, may use a shorter spacer to position the center of gravity of the golf club 10 closer to the grip 16.

The weight 58 is an elongated member that may be fabricated from a suitable material, such as metal or brass. The weight 58 includes a first end 78 and an oppositely located second end 81. At the first end 78, the weight 58 includes a first threaded portion 83 configured to threadably engage the second threaded portion 76 of the spacer 56. At the second end 81, the weight 58 may include a second threaded portion (not shown) for attaching additional weights (also not shown) thereto. The weight 58 may include various amounts of weight, providing a user with the ability to customize the amount of weight added to the golf club 10.

The sleeve 60 is a resiliently compressible member that may be fabricated from a suitable material, such as foam or a polymeric material. The sleeve 60 is configured to extend over the weight 58, or, alternatively, may be made integral with the weight 58. The sleeve 60 may be constructed larger than the cavity 24 of the shaft 14 so that when the weight system 50 is inserted into the grip 16 and into the cavity 24 of the shaft 14, the sleeve 60 compresses and forcefully engages the cavity 24. In this regard, the sleeve 60 may resist axial and/or radial movement of the weight 58 and the weight system 50 within the cavity 24 and may prevent the weight 58 and the weight system 50 from banging and/or vibrating against the cavity 24 during use.

With reference to FIGS. 2-6, an exemplary method of attaching the weight system 50 to the grip 16 will be described. A weight 58 may be selected having an amount of weight desired be added to the golf club 10. The sleeve 60 may be installed onto the weight 58. A spacer 56 may be selected having a length for positioning the center of gravity of the golf club 10 at a desired location between the head 12 and the grip 16. The first threaded portion 83 of the weight 58 and the second threaded portion 76 of the spacer 56 may be threadably engaged. A securing adhesive such as Loctite® may be applied between the threaded portions 83, 76 to keep the weight 58 and the spacer 56 from threadably disengaging. The first threaded portion 74 of the spacer 56 and the second threaded portion 64 of the weight cap 54 may be threadably engaged. A securing adhesive such as Loctite® may be applied between the threaded portions 74, 64 to keep the spacer 56 and the weight cap 54 from threadably disengaging. The weight system 50 may be inserted into the opening 33 of the grip 16 and into the cavity 24 of the shaft 14. A securing key such as an Allen wrench (not illustrated) may be used to threadably engage the securing socket 66 of the weight cap 54 to the first threaded portion 62 of the weight cap 54. A securing adhesive such as Loctite® may be applied between the threaded portions 62, 48 to prevent the weight cap 54 and the insert 34 from threadably disengaging. Once attached, it may be appreciated that the second end 81 of the weight 58 may be aligned with the second end 28 of the grip 16. Alternatively, the second end 81 of the weight 58 may be positioned elsewhere between the ends 26, 28 of the grip 16, such as closer to the first end 26 as shown in FIG. 1, for example.

The weight system 50 may be detached from the grip 16 by disengaging the first threaded portion 62 of the weight cap 54 from the threaded portion 48 of the insert 34. The securing key may engage the securing socket 66 of the weight cap 54 to loosen the engagement between the threaded portions 62, 48. Accordingly, the weight system 50 may be separated from the grip 16.

Figure 6A:
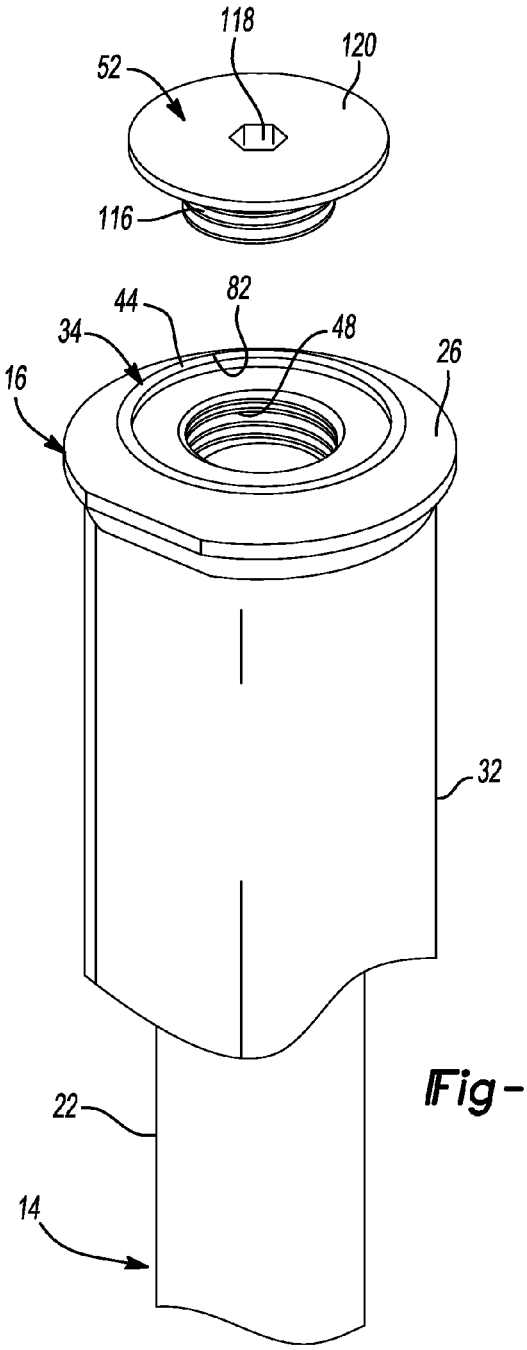
FIG. 6A is a partially exploded view of a grip cap in accordance with the teachings of the present disclosure together with the grip and the shaft.
Figure 6B:
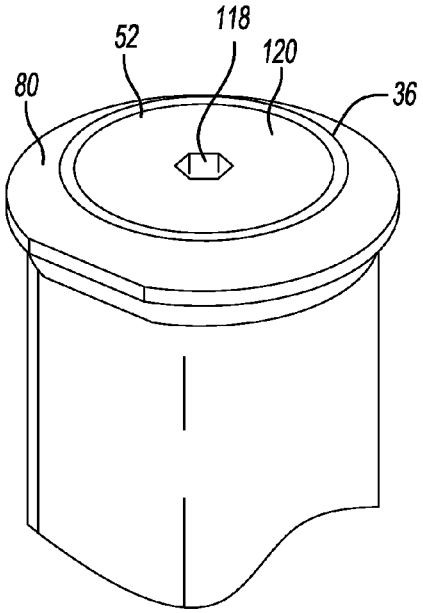
FIG. 6B is a top view of the grip cap inserted within the insert.

With reference to FIGS. 6A and 6B, if additional weight via the weight system 50 is not desired to be added to the golf club 10, the grip cap 52 may instead threadably engage the insert 34. The grip cap 52 is an annular member that may be fabricated from a suitable material, such as metal or a polymeric material. The grip cap 52 includes a threaded portion 116 and a securing socket 118 located on a top end 120 of the threaded portion 116. The threaded portion 116 is configured to threadably engage the threaded portion 48 of the insert 34 when the weight system 50 is not attached to the grip 16. The top end 120 of the grip cap 52 may be fabricated from, over molded with, the same material as the grip 16 to provide a "finished" or uniform look when the grip cap 52 engages the insert 34. The securing socket 118 may have a hexagonal shape, for example, and using a securing key, such as a hex key (not shown), for example, the threaded portion 116 of the grip cap 52 and the threaded portion 48 of the insert 34 may be threadably engaged and tightened. A securing adhesive such as Loctite® may be applied between the threaded portions 116, 48 to prevent the grip cap 52 and the insert 34 from threadably disengaging.

The grip cap 52 may be detached from the grip 16 by disengaging the threaded portion 116 of the grip cap 52 from the threaded portion 48 of the insert 34. The securing key may be used to engage the securing socket 118 of the grip cap 52 to loosen the threaded portion 116, 48. Accordingly, the grip cap 52 may be separated from the grip 16.

Figure 7A:
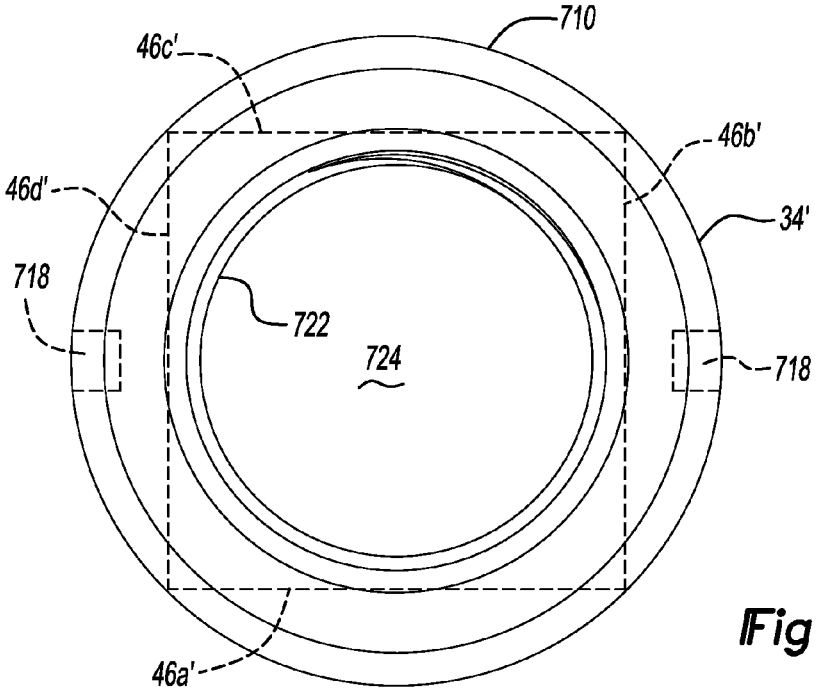
FIG. 7A is a top view of an alternative example of the insert.
Figure 7B:
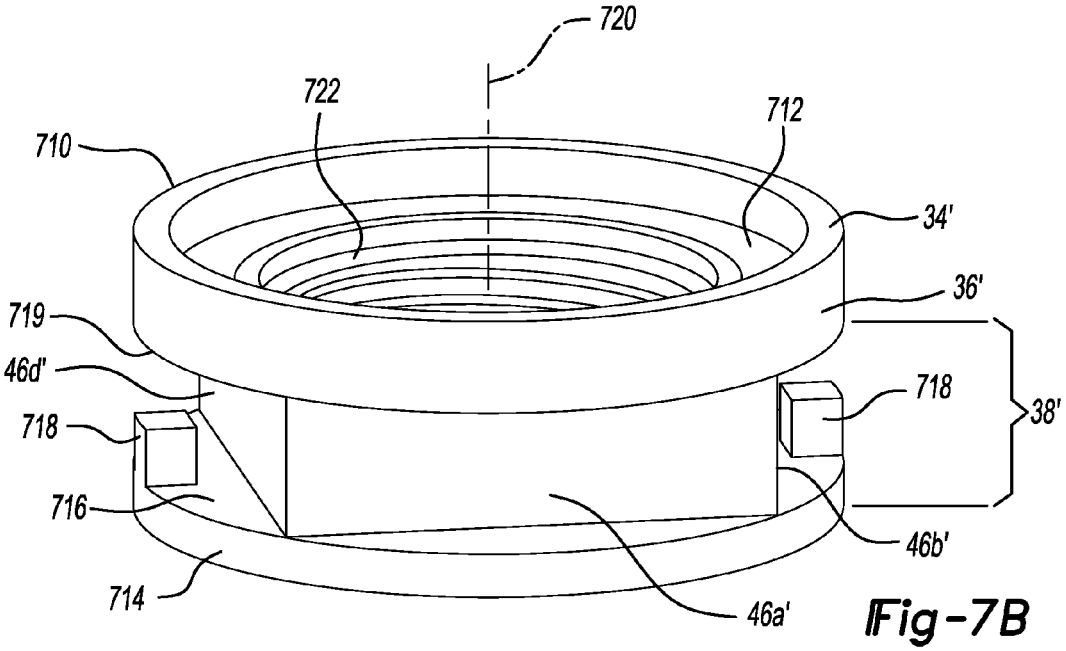
FIG. 7B is a perspective view of the alternative example of the insert.

Referring now to FIGS. 7A and 7B, an alternative embodiment of an insert 34' is set forth. In this example, the insert 34' also has an annular flange 36' and a body portion 38'. The flange 36' is configured in the same manner set forth described above with respect to the insert 34. The flange 36' has a recessed portion 712 that is used for receiving the weight cap 54 or the grip cap 52 as described above. Thus, the interior portion of the insert 34' is configured in the same manner set forth above.

The insert 34' has body portion 38' which is slightly different than that set forth above. In this example, the body portion 38' also includes walls 46A', 46B', 46C' and 46D'. The wall 46C' is obscured in these figures. Thus, the body portion 38' also has polygonal sides or walls in a similar manner to that set forth above. In this example, the body 38' has a secondary flange 714 that is added adjacent to the body portion 38' opposite the flange 36'. The secondary flange 714 has a surface 716 that may be referred to as a top surface. The surface 716 is facing in an opposite direction as the bottom surface of the flange 36'. The surface 716 may include projections 718 extending therefrom. In this example, only two projections 718 are illustrated. However, any number of projections may be used.

The insert 34' is suitable for injection molding or other types of molding. The insert 34' may be made of metal or other types of material capable of withstanding the heat of a molding process. The walls 46A', 46B', 46C', 46D' help prevent the rotation of the insert 34' during the installation and removal of the weight system 50 and the grip cap 52. In addition, the projections 718 increase the resistance of the insert 34' from rotating during the installation and removal of the weight system 50 and the grip cap 52. The projections 718 extend in a longitudinal direction parallel to a longitudinal axis 720 from the surface 716 toward the bottom surface 719 of the flange 710.

Threads 722 may be disposed inside an opening 724 that extends longitudinally through the insert 34'.

Figure 8:
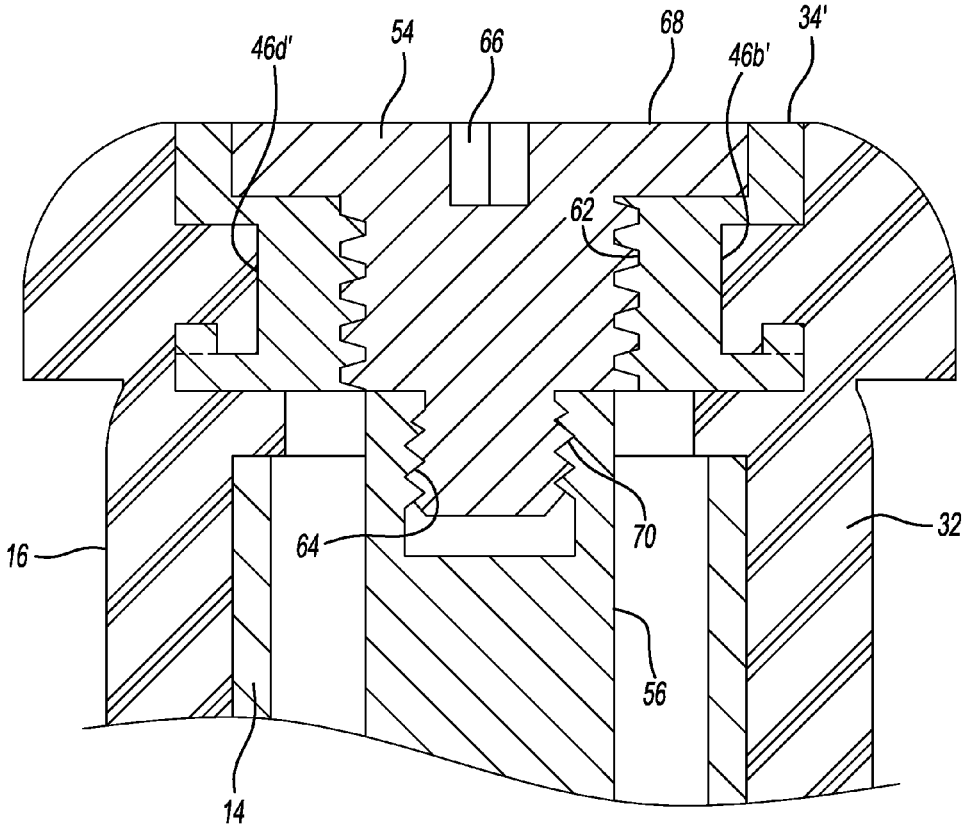
FIG. 8 is a cross-sectional view of the alternative example of the insert inserted within the grip.

Referring now to FIG. 8, the grip 16 is illustrated molded around the insert 34'. The insert 34' has the material of the grip adjacent to the walls 46A', 46B', 46C' and 46D' (of which only walls 46B' and 46D' are partially shown). The weight assembly 50 fits within the recessed portion 712.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification and the following claims.

What is claimed is:

1. A golf club grip for a golf club comprising:

an elongated member having a first end, a second end, an inner surface and an outer surface, the first end is configured to receive a golf club shaft, the second end includes an opening, said elongated member comprising a stopper extending inward from the inner surface a predetermined distance; and an insert received in said opening and comprising a first flange having a first lateral cross-sectional shape, said first flange comprising an upper surface, the upper surface is flush with the second end of the elongated member when the insert is received in the opening, a body portion extending from the first flange, said body portion comprising a first threaded portion extending within the first flange and the body portion, said stopper axially separating the golf club shaft and insert.

2. The golf club grip of claim 1, wherein said second end defines a recess, said first flange being received in said recess.

3. The golf club grip of claim 1, wherein the body portion comprises a plurality of walls.

4. The golf club grip of claim 3, wherein the plurality of walls form a regular polygon.

5. The golf club grip of claim 3, wherein the plurality of walls comprises four walls.

6. The golf club grip of claim 5, wherein the four walls comprise a square.

7. The golf club grip of claim 1, wherein the body portion comprises a plurality of walls and the plurality of walls form a regular polygon.

8. The golf club grip of claim 1, wherein the body portion comprises a plurality of walls and the plurality of walls comprises four walls.

9. The golf club grip of claim 8, wherein the four walls comprise a square.

10. A golf club grip for a golf club comprising:

an elongated member having a first end, a second end, an inner surface and an outer surface, the first end is configured to receive a golf club shaft, the second end includes an opening, said elongated member comprising a stopper extending inward from the inner surface a predetermined distance; and an insert received in said opening and comprising a first flange, a body portion extending from the first flange, and a first threaded portion extending within the first flange and the body portion, said stopper axially separating the golf club shaft and insert, said insert comprises a second flange adjacent to the body portion and axially spaced apart from the first flange.

11. The golf club grip of claim 10, wherein the body portion comprises a plurality of walls.

12. The golf club grip of claim 11, wherein the plurality of walls form a regular polygon.

13. The golf club grip of claim 11, wherein the plurality of walls comprises four walls.

14. The golf club grip of claim 13, wherein the four walls comprise a square.

15. The golf club grip of claim 10, wherein the second flange comprises at least one projection engaging the elongated member.

16. The golf club grip of claim 15, wherein the at least one projection extends in a longitudinal direction from the second flange.

17. The golf club grip of claim 10, wherein the stopper comprises a continuous band around an inner surface of the elongated member.

18. The golf club grip of claim 10, wherein the predetermined distance is greater than or equal to a thickness of the shaft.

19. The golf club grip of claim 10, wherein the stopper comprises a step shape.

20. The golf club grip of claim 10, wherein the stopper comprises a first wall and a second wall extending in a perpendicular direction to an inner wall of the grip, and a third wall extending between the first wall and the second wall.

21. The golf club grip of claim 20, wherein the third wall is perpendicular to the first wall and the second wall and parallel to the inner wall of the grip.

22. A grip system for a golf club including a shaft, the system comprising:

the grip as recited in claim 10; and a weight comprising a first weight comprising a second threaded portion configured to engage the first threaded portion of the insert.

23. The system of claim 22, wherein the weight is received in the elongated member such that a first weight end is flush with the elongated member.

24. A golf club comprising:

a head;

a shaft having a first shaft end and a second shaft end, the second shaft end is secured to the head;

a grip system as recited in claim 22.

25. The golf club of claim 24, wherein the shaft is directly adjacent to the stopper and the insert is directly adjacent to the stopper.

26. The golf club of claim 24, wherein the grip is fabricated from a first material and the insert is fabricated from a second material that is different from the first material.

* * * * *